United States Patent [19]

Gley

[11] 4,171,827

[45] Oct. 23, 1979

[54] SKI BRAKE

[76] Inventor: Paul Gley, 79 Fair Acres, Mystic, Conn. 06355

[21] Appl. No.: 888,174

[22] Filed: Mar. 20, 1978

[51] Int. Cl.[2] ..... A63C 7/10

[52] U.S. Cl. ..... 280/605

[58] Field of Search ..... 280/605, 604

[56] References Cited

U.S. PATENT DOCUMENTS

| | | | |
|---|---|---|---|
| 3,704,024 | 11/1972 | Martin | 280/605 |
| 3,917,297 | 11/1975 | Fruh | 280/605 |
| 3,918,730 | 11/1975 | Schultes | 280/605 |

*Primary Examiner*—Joseph F. Peters, Jr.
*Assistant Examiner*—Milton L. Smith
*Attorney, Agent, or Firm*—Albert W. Hilburger

[57] ABSTRACT

A ski brake mounted on a ski and retained normally in a retracted position. When the skier's boot becomes separated from the binding on the ski in a casual manner, such as during ascent on a chairlift, a strap joining the skier's boot and the ski brake permits the ski to remain connected to the skier, although in a dangling condition. However, should the skier's boot become separated from the binding in an abrupt manner, as when skiing, the strap releases a retention mechanism holding the brake in a first or retracted position. Thereupon, the strap is completely separated from the brake and the brake is rapidly moved by a spring into a second position such that a brake shoe extends below a lower surface of the ski for engaging ice, snow, and the like. The brake shoe has a roughened outer surface as a further aid in impeding advancement of the runaway ski. Whenever convenient to the skier, a release mechanism on the strap can be operated to disconnect the strap from the boot.

10 Claims, 12 Drawing Figures

SKI BRAKE

BACKGROUND OF THE INVENTION

1. Field of Invention

This invention relates generally to snow skis and, more particularly, to an improved mechanism for impeding the advancement of a runaway ski.

2. Description of the Prior Art

Snow skiing has become one of the world's fastest growing sports. As increasing numbers of enthusiasts are drawn to the ski slopes each winter, amateurs and experts alike are continuously seeking newer and improved equipment to further improve their skills, to extend their performance and enjoyment, and to increase the safety of the sport. The present invention is concerned primarily with the latter category, but will also benefit skiers in the other recited categories.

In the past, it was known to provide skis with brakes which were actuated upon release of a skier's boot from the binding. It was also known to provide straps connecting the skier's boot with the ski enabling the ski to remain with the skier in the event the skier's boot became disengaged from the binding.

Unfortunately, these known devices were not always successful in avoiding the problems of a runaway ski and, indeed, often created new and previously unknown problems. Specifically, there are two areas of concern to skiers and operators of ski areas alike. The one area of concern which previously has received the most attention relates to the situation in which the boot of the downhill skier is suddenly and abruptly disengaged from the binding. In such an event, it is desirable from the standpoint of the skier to immediately and completely disengage the boot of the skier from the ski so as to avoid injury to the skier. At the same time, it is desirable to impede the further advancement of the runaway ski to enable its retrievel by the skier with a minimum of lapsed time and effort. Of course, early retrieval also removes the ski as a hazard to other skiers utilizing the slope.

The other area of concern to skiers and operators of ski areas centers around problems which arise when a skier ascends the slope, as for example, on a chairlift. In the first place, in the absence of a runaway strap, a ski released from a skier while the skier is ascending could fall on skiers below causing injury and potential liability to both the skier and the operator of the ski area. Additionally, as mentioned above, a fallen ski lying unattended on the slope is a potential hazard to other skiers as they travel down hill. Another potentially serious problem can arise with respect to the performance of the watch person positioned at the top of the chairlift. It is that person's customary duty, as the chairlift approaches the top of the slope, to either permit a skier to descend from the ski ramp or to eject the skier because of some apparent difficulty. Thus, it is important for the watch person to render quick decisions to determine whether an oncoming skier is in a proper condition to descend. It will be appreciated that because of the speed of the ascent of the chairlift and the numbers of occupants on the lift, it is often difficult for the watch person to rapidly take note of a skier absent a ski. A dangling ski, which would be cause for immediate rejection of that skier, would be much more apparent to the watch person than the absence of a ski. Yet another difficulty, although not as serious as those previously recited, is the logistical problem of reuniting the skier with the lost ski. Unfortunately, although conventional straps served to keep skier and ski united during ascent, they did not generally permit automatic separation of ski and skier when desired during descent, often resulting in injury to the skier.

SUMMARY OF THE INVENTION

It was with recognition of these problems and the state of the prior art that the present invention was conceived. The present invention relates generally to a ski brake mounted on a ski and retained normally in a retracted position. When the skier's boot becomes separated from the binding on the ski in a casual manner, such as during ascent on a chairlift, a strap joining the skier's boot and the ski brake permits the ski to remain connected to the skier, although in a dangling condition. In this fashion, it would be readily apparent to the watch person, and the skier would be rejected at the top of the slope. However, should the skier's boot become separated from the binding in an abrupt manner, as when skiing, the strap releases a retention mechanism holding the brake in a first or retracted position. Thereupon the strap joining the skier's boot and the ski brake is completely separated from the brake and the brake is rapidly moved by a spring into a second position such that a brake shoe extends below a lower surface of the ski for engaging ice, snow and the like. The brake shoe is preferably provided with a roughened outer surface as a further aid in impeding advancement of the runaway ski and, desirably, to bring the ski to a halt a short distance from the downed skier. Furthermore, whenever convenient to the skier, a release mechanism can be operated to readily disconnect the strap from the boot.

In this manner, the strap serves a two fold purpose. First, it is designed to retain the weight of the ski safely if the ski becomes separated from the boot in a casual manner, as for example, while the skier is ascending the slope on a chairlift. At the same time, should the skier's boot become separated from the binding in an abrupt manner, as during skiing, the strap serves to trigger the retention mechanism holding the ski brake in its retracted position allowing movement of the brake into its extended position and simultaneouly allowing separation of the ski and the skier'boot. By thus disconnecting the ski from the skier, the attendant hazard of a wind milling ski still attached to the skier is avoided and the runaway ski is brought to a halt at a location proximate to the downed skier.

The invention, as disclosed, is safe, compact, lightweight, and is automatically operable to perform its function instantaneously.

Other and further features of the invention will become apparent from the following description taken in conjunction with the following drawings. It is to be understood that both the foregoing general description and the following detailed description are exemplary and explanatory but are not restrictive of the invention. The accompanying drawings, which are incorporated in and constitute a part of this invention, illustrate one embodiment of the invention, and together with the description, serve to explain the principles of the invention.

DESCRIPTION OF THE PREFERRED EMBODIMENT S

Figure 1:
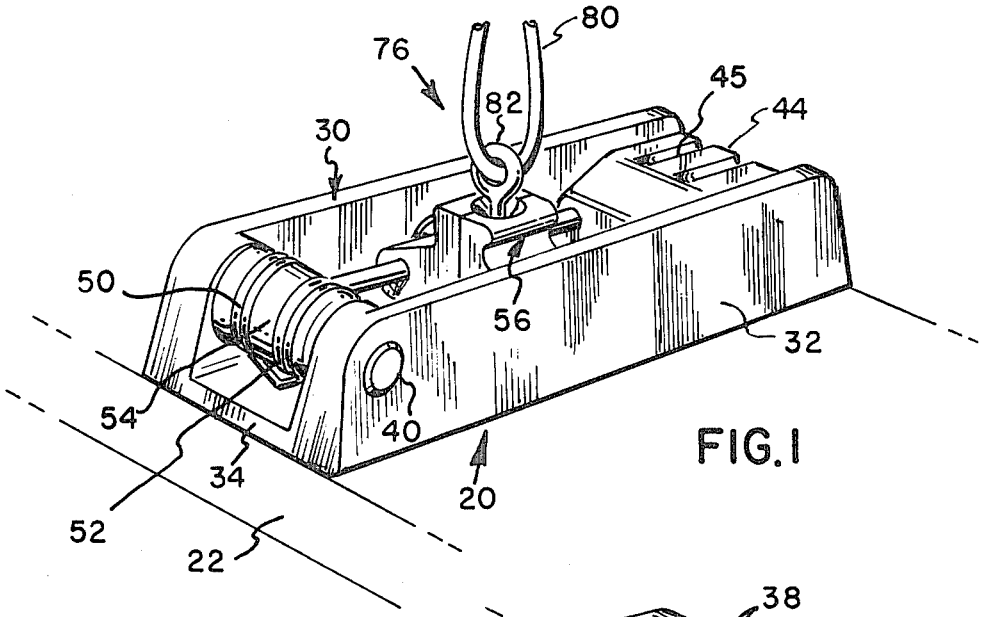
FIG. 1 is a perspective view of a portion of a snow ski utilizing the invention and illustrating the invention in its normally retracted position.
Figure 2:
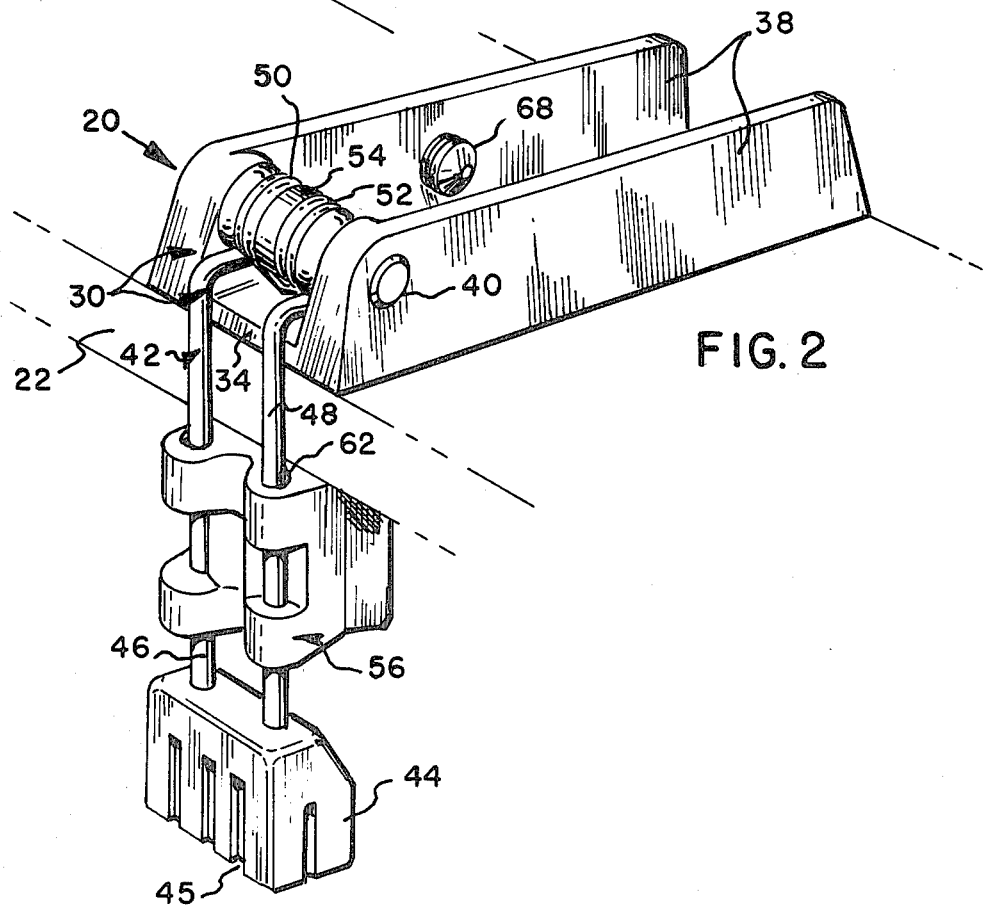
FIG. 2 is a perspective view of a portion of a snow ski utilizing the invention as illustrated in FIG. 1 but illustrating the invention in its extended position.

Refer now to the drawings and initially to FIGS. 1 and 2 which generally illustrate the invention as it is applied to a snow ski. In FIG. 1, the invention, which is generally indicated by reference numeral 20, is illustrated in its retracted or inoperative position and in FIG. 2 is illustrated as being in its extended or operative position. The invention 20 is preferably positioned on a snow ski 22 immediately behind a heel binding element 24 (See FIGS. 3, 4, and 5) which, together with a toe binding element 26 serves to releasably secure a boot 28 of a skier to the ski 22. The invention 20 is preferably of a low profile so as to assure a minimum of interference with the skier's performance. It will further be appreciated that the description of the boot binding elements 24 and 26 is merely illustrative of any well known construction and forms no part of the present invention.

In accordance with the invention, an improvement is provided for impeding the advancement of a runaway ski comprising: braking means mounted on said ski movable between a retracted inoperative position and an extended position for engaging ice, snow, and the like; resilient means intermedite said ski and said braking means biasing said braking means toward its extended position; retention means operatively associated with said braking means and movable between a normally closed position engaged with said ski holding said braking means in its retracted position and an open position released from said ski permitting said braking means to move freely toward its extended position; and actuating means responsive to a predetermined force to move said retention means to its open position.

Figures 6, 11:
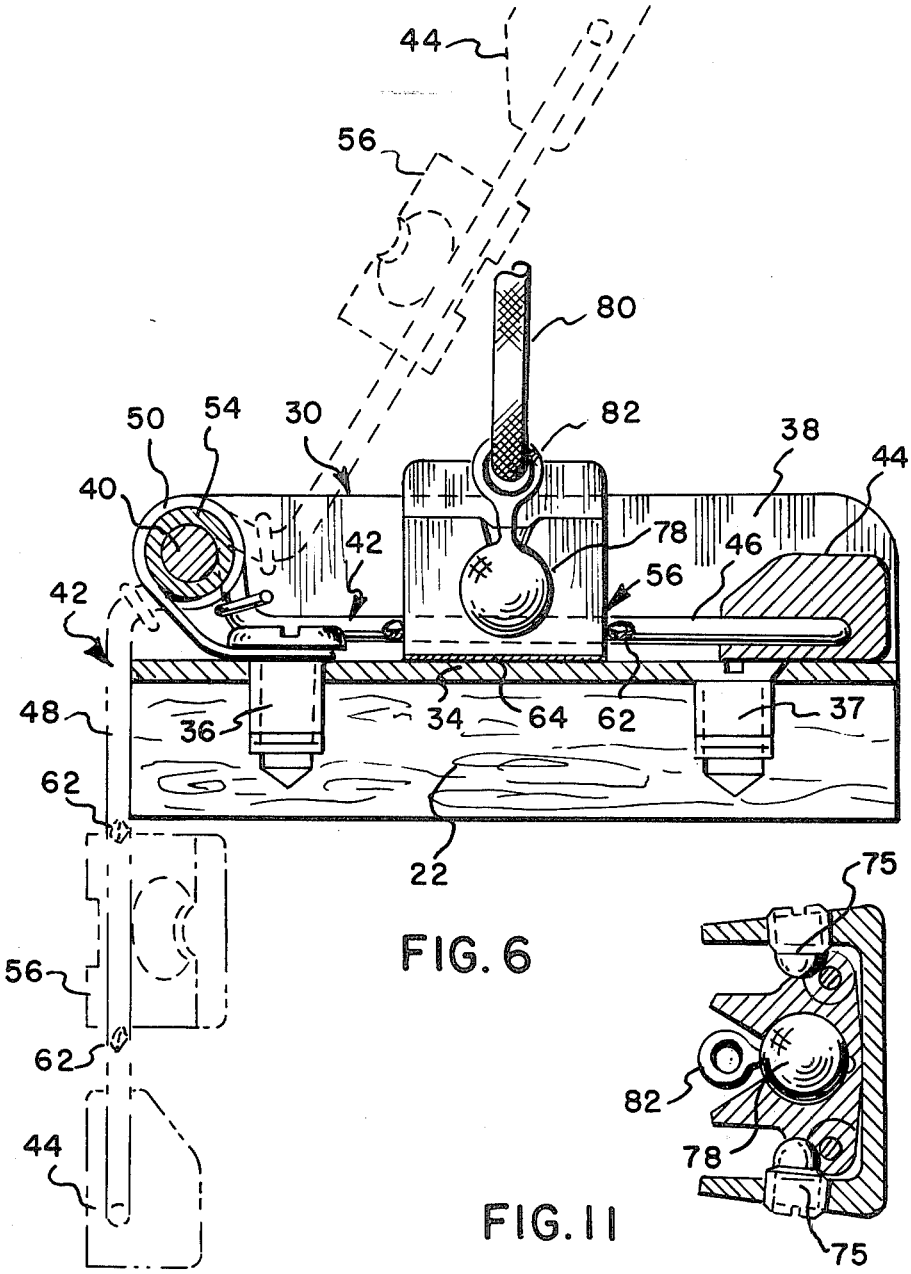
FIG. 6 is a cross-section view taken transversely of the ski illustrated in FIGS. 1 and 2 illustrating the invention by solid lines in its retracted position and by phantom lines in both an intermediate position and in an extended position.
FIG. 11 is a cross section view similar to FIG. 8 but illustrating another embodiment of the invention.

As embodied herein, a braking mechanism generally indicated by reference numeral 30 includes a base 32 of generally u-shaped cross-section having a bight 34 mounted to an upper surface of the ski 22 by suitable fasteners 36 and 37 (FIG. 6) such that the base extends transverse of a longitudinal axis of the ski 22. A pair of spaced apart sidewalls 38 extend upwardly from the bight 34. As seen in FIGS. 1, 2, and 6, a pivot pin 40 extends between the sidewalls 38 adjacent one edge of the ski 22, the longitudinal axis of the pivot pin being substantially parallel to the edge of the ski.

An arm 42 is rotatably mounted on the pivot pin 40 and includes a brake shoe 44 suitably fixed to an end of the arm distant from the pivot pin 40. The brake shoe is preferably composed of a plastic material of the type which could be molded onto the arm 42, but any other material capable of performing the end result of the invention would be acceptable. Also, the brake shoe 44 may be formed with a plurality of grooves 45 or other appropriate expeditents to further improve its performance. The arm 42 is movable between a retracted or inoperative position (see FIG. 1 and the solid line representation in FIG. 6) lying between the sidewalls 38 of the base 32 in a position generally parallel with the upper surface of the ski 22 and an extended position lying in a plane transverse of the upper surface of the ski with the brake shoe 44 extending below a plane of the lower surface of the ski (see FIG. 2 and the phantom line representation in FIG. 6).

In its preferred construction, the arm 42 includes a pair of spaced, substantially parallel, resilient bars 46 and 48 which are appropriately rolled, as seen in FIG. 6, at their ends distant from the brake shoe 44 to rotatably embrace the pivot pin 40. The bars 46 and 48 operate as a unit except that their relative resiliency serves a desired purpose which will be explained hereinafter. A pair of bushings 49 are received on the pivot pin 40 and serve as spacers, respectively, between the bars 46 and 48 and their associated sidewall 38.

Resilient means in the form of a pair of modified coil springs 50 and 52 are received on the pivot pin 40 intermediate the bars 46 and 48 and are themselves separated by a spacer 54. One end of each spring 50 and 52 is received under a round head of the fastener 36 and firmly secured against an upper surface of the bight 34. The opposite ends of the springs 50 and 52 are respectively formed to engage, respectively, the bars 46 and 48 in a region adjacent the pivot pin 40. In this manner, the springs 50 and 52 serve to continuously bias the arm 42 toward the extended position.

Figure 10:
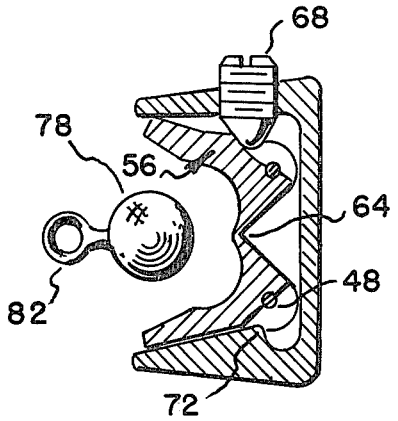
FIG. 10 is a cross-section view taken along line 10—10 in FIG. 9.

A retention mechanism is generally indicated by reference numeral 56 and serves to retain the arm 42 in a normally retracted position. To this end, the retention mechanism 56 includes a pair of opposed clamp members 58 and 60 which are pivotally mounted, respectively, on the bars 46 and 48 and are held in position between the knurled portions 62 formed on the bars. The clamp members 58 and 60 are preferably formed of a resilient material such as polyethylene or one of its derivatives and are joined together along an isthmus of material on hinge 64 common to each of the members. Such a hinge is commonly referred to in the trade as a living hinge. By reason of the hinge 64, the clamp members are joined so as to move simultaneously and in a complementary fashion between a closed position (FIG. 8) and an open position (FIG. 10).

Figure 7:
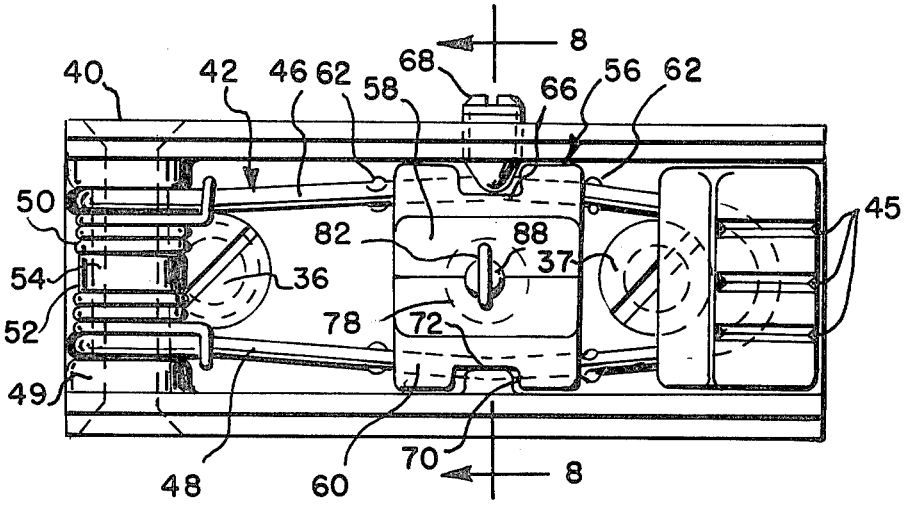
FIG. 7 is a top plan view of the invention in its retracted position.

A portion of the clamp member 58 is cut away as at 66 (FIGS. 7 and 9) in order to expose a length of the bar to an adjustable strike 68 which is threadedly received in a sidewall 38 of the base 32 and suitably slotted to receive an end of a screwdriver for adjustment. Similarly, the clamp member 60 is cut away as at 70 to expose a portion of the bar 48 to a fixed strike 72 integral with the opposite sidewall 38. It will be appreciated that the distance from the pivot locations of the clamp members 58 and 60 on the bars 46 and 48 to the hinge 64 is longer in the sum than the usual distance between the bars 46 and 48 in their relaxed condition. Hence, as seen in FIG. 7, when the clamp members 58 and 60 assume the closed position, the bars 46 and 48 spread outwardly beneath the strikes 68 and 72 (see especially FIG. 8). When the retention mechanism 56 assumes the position illustrated in FIGS. 7 and 8, it holds the arm 42 in its retracted position notwithstanding the bias of the springs 50 and 52. It is additionally noteworthy that the clamp members 58 and 60 mutually define a substantially enclosed cavity 74 when they assume the closed position (FIG. 8).

Figure 8:
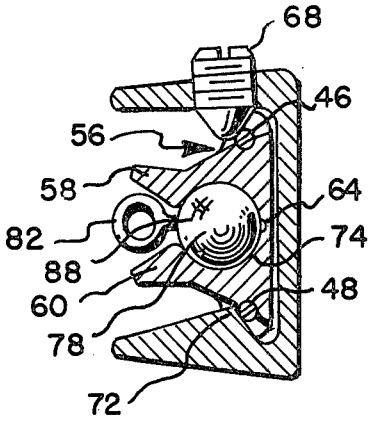
FIG. 8 is a cross-section view taken generally along line 8—8 in FIG. 7.
Figure 9:
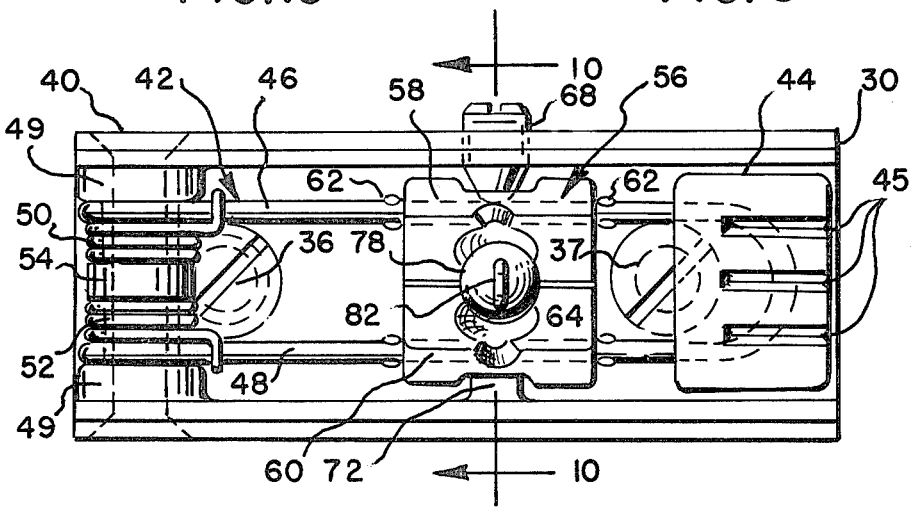
FIG. 9 is a top plan view of the invention in its unlocked condition but immediately prior to movement of the brake arm to the extended position.

FIG. 11 is similar in construction to FIG. 8 except that it illustrates a pair of adjustable strikes 75 which may be of the spring-loaded variety. As with the adjustable strike 68, they are threadedly received in sidewalls 38*a* and suitably slotted to receive an end of a screwdriver for adjustment.

Figure 3:
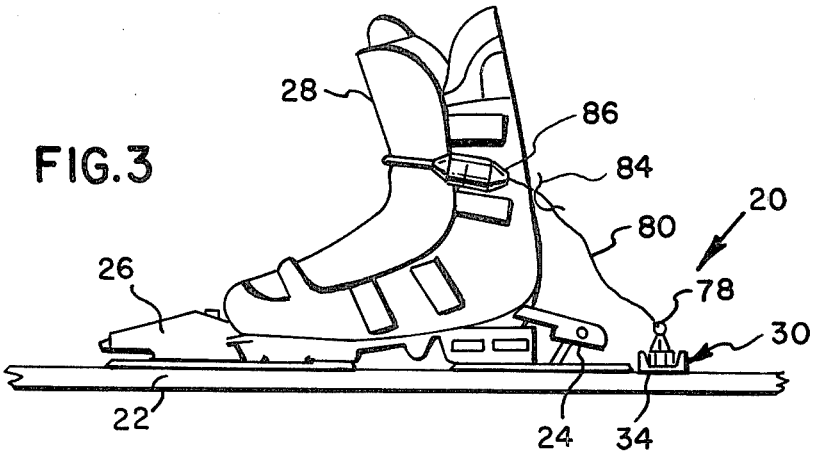
FIGS. 3, 4, and 5 are all side elevation views of a portion of a ski and its binding together with a skier's boot in a sequence of positions as the boot is being separated from the binding in an abrupt manner.
Figure 12:
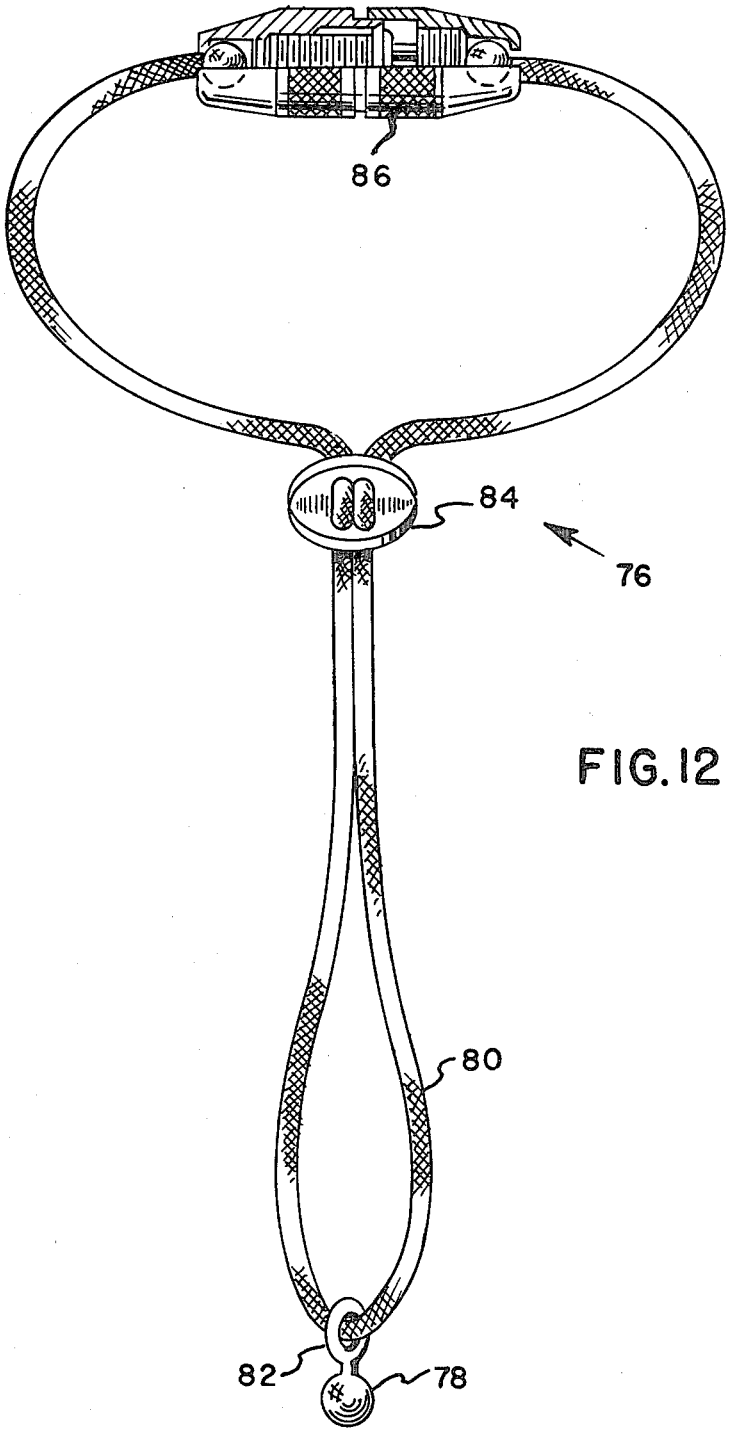
FIG. 12 is a front elevation view of a mechanism for actuating the invention, including a release cord which normally extends between the skier's boot and the ski.

An actuating mechanism is generally indicated by reference numeral 76 in FIGS. 1 and 12 and includes a cam member or ball 78 receivable within the cavity 74 and thereby substantially enveloped by the clamp members 58 and 60 (see FIG. 8). A release cord 80 is looped so as to pass through an eyelet 82 fixed to the ball 78. Distant from the ball 78, the release cord 80 passes around the boot 28 of the skier (FIG. 3). A locking tab 84 is suitably received on the cord 80 and is adjustable to enable the cord to conform to the size of the boot. The free ends of the release cord 80 may be joined together by an appropriate release device 86, not a part of this disclosure, enabling the rapid release of the cord 80 from the boot 28, according to the desires of the skier.

In operation, the skier utilizing the invention would have the release cord 80 encircling his boot 28 with the ball 78 held within the retention mechanism 56 in the manner previously described and as illustrated in FIG. 3. In the event the boot 38 should become separated from the binding elements 24 and 26 in a casual manner, that is, when the force applied by the boot to the ball 78 through the release cord 80 is less than a predetermined magnitude, the retention mechanism would continue to retain the ball 78 and the ski 22 would merely dangle on the end of the cord 80 from the boot 28.

Figure 4:
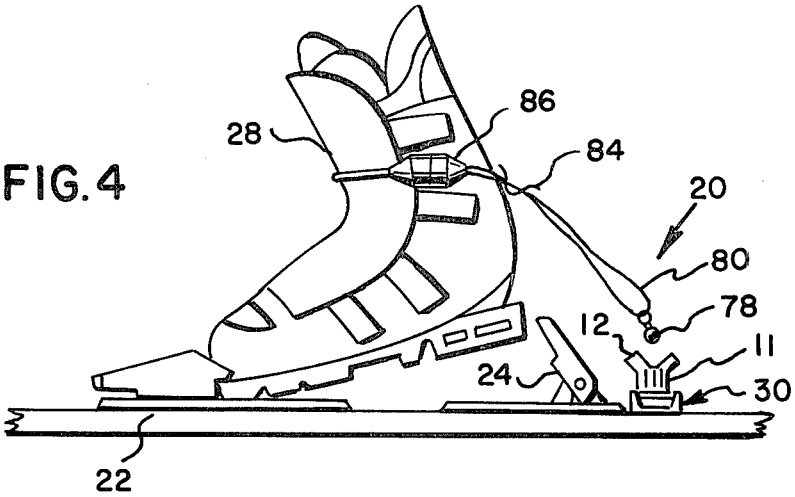
Figure 5:
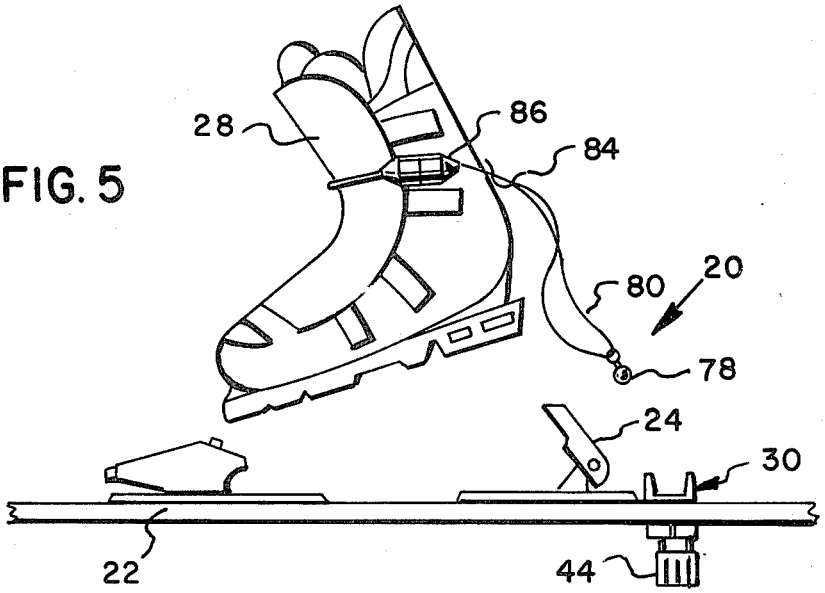

However, should the boot 28 be released from the binding elements 24 and 26 in an abrupt manner, as seen in FIGS. 4 and 5, that is, when the force applied by the boot through the cord 80 to the ball 78 is greater than a predetermined magnitude, then the retention mechanism 56 is opened thereby releasing the ski 22 from the cord 80 and enabling the rapid movement of the arm 42 to the extended position.

What occurs in actuality is that the ball 78 acts as a cam operating against the surface area of the cavity 74, enlarging an opening 88 defined by the clamp members 58 and 60 at a location distant from the hinge 64 until such time that the hinge 64 passes over center enabling the bars 46 and 48 to be freed from the strikes 68 and 72. By means of the adjustable strikes 68 or 75, the magnitude of the force required to trigger the retention mechanism 56 is adjustable according to the desires of the skier.

In any event, once the actuating mechanism 76 has triggered the retention mechanism 56, the ski falls clear of the skier. If the ski lands upside down or on its edges, it will be brought quickly to a halt. If it lands right side up, the extended brake shoe 44 is operable to engage snow, ice, and the like, to impede its advancement and enable early retrieval of the ski.

The invention in its broader aspects is not limited to the specific details shown and described; departures may be made from such details without departing from the principles of the invention and without sacrificing its chief advantages.

What is claimed is:

1. In combination with a ski including a binding for securing a skier'boot to the ski, an improvement for impeding the advancement of a runaway ski comprising:

a base of generally u-shaped cross section including a bight mounted to an upper surface of said ski and extending transverse of a longitudinal axis thereof and a pair of spaced apart sidewalls extending upwardly from said bight;

a pivot pin extending said sidewalls adjacent an edge of said ski;

an arm rotatably mounted on said pivot pin including a brake shoe fixed thereto distant from said pivot pin, said arm movable between a retracted position lying between said sidewalls generally parallel with an upper surface of said ski and an extended position lying in a plane transverse of the upper surface of said ski with said brake shoe extending below a plane of the lower surface of said ski;

resilient means intermediate said base and said arm biasing said arm toward its extended position;

a retention mechanism pivotally mounted on said arm for movement between a normally closed position engaging said base and thereby holding said arm in its retracted position and an open position disengaged from said base permitting said arm to move freely toward its extended position; and actuating means normally enaged with said retention mechanism and attached to the skier's boot operable to move said retention mechanism to the open position in response to the abrupt release of the skier's boot from said binding.

2. The combination as set forth in claim 1 wherein said retention mechanism includes a pair of opposed clamp members each pivotally mounted on said arm and each engaging said base in the normally closed position and each disengaged from said base in the open position, and hinge means joining said members such that they move simultaneously and in a complementary fashion between the open and closed positions, said arm biasing said opposed clamp members to the closed position.

3. The combination as set forth in claim 2 wherein said actuating means includes a ball, an eyelet mounted on said ball, and a strap connecting said eyelet and the skier's boot, and wherein said opposed clamp members include opposed cam surfaces and together define a cavity between them when they are in the closed position such that the rapid release of the skier's boot from the binding on said ski draws said ball from the cavity and along said cam surfaces to move said clamp members to the open position.

4. The combination as set forth in claim 1 wherein said brake shoe has a roughened outer surface.

5. The combination as set forth in claim 4 wherein the outer surface of said brake shoe has grooves formed therein..

6. The combination as set forth in claim 1 wherein said arm includes a pair of spaced substantially parallel resilient bars, and wherein said retention mechanism includes a pair of opposed clamp members pivotally mounted, respectively, on said resilient bars, each of said bars engaging said base in the normally closed position and each of said bars being disengaged from said base in the open position, and hinge means joining said clamp members such that they move simultaneously and in a complementary fashion between said open and closed positions, said bars biasing said clamp members to the closed position.

7. The combination as set forth in claim 6 wherein said clamp members are composed of a resilient material and wherein said hinge means is a living hinge.

8. The combination as set forth in claim 1 wherein said resilient means is a coil spring received on said pivot pin, one end of said spring fixed to said base and the other end engaging said arm.

9. The combination as set forth in claim 6 including strike means on said base engageable with said bars when said retention mechanism is in the closed position, said strike means being adjustable to define the magnitude of force required by said actuating means to move said clamp members to the open position.

10. In combination with a ski including a binding for securing a skier's boot to the ski, an improvement for impeding the advancement of a runaway ski comprising:

braking means mounted on said ski movable between a retracted inoperative position and an extended position for engaging ice, snow, and the like;

resilient means intermediate said ski and said braking means biasing said braking means toward its extended position;

retention means operatively associated with said braking means and movable between a normally closed position engaged with said ski holding said braking means in its retracted position and an open position released from said ski permitting said braking means to move freely toward its extended position, said retention means including a pair of opposed clamp members pivotally mounted on said braking means for relative movement between said open and closed positions and hinge means joining said clamp members such that they move simultaneously and in a complementary fashion between the open and closed positions, said clamp members mutually defining a substantially enclosed cavity when they assume the closed position; and actuating means responsive to a predetermined force to move said retention means to its open position including a cam member substantially enveloped within the cavity defined by said clamp members and held against movement when said clamp members assume the closed position, and said cam member being free from said clamp members when said clamp members assume the open position, and said actuating means further including a release cord joining said cam member to the skier's boot such that the rapid release of the skier's boot from the binding on said ski is effective to draw said cam member out of the cavity and to move said clamp members to the open position.

* * * * *